US009315911B2

(12) United States Patent
Asada et al.

(10) Patent No.: US 9,315,911 B2
(45) Date of Patent: Apr. 19, 2016

(54) ELECTROLYZER APPARATUS

(75) Inventors: Shigeo Asada, Ibaraki (JP); Kazuhiko Taguchi, Sakai (JP); Kouichi Taura, Osaka (JP); Koichi Nakahara, Suita (JP)

(73) Assignee: TAIKO PHARMACEUTICAL CO., LTD., Suita-Shi, Osaka (JP)

( * ) Notice: Subject to any disclaimer, the term of this patent is extended or adjusted under 35 U.S.C. 154(b) by 94 days.

(21) Appl. No.: 13/634,145

(22) PCT Filed: Mar. 17, 2011

(86) PCT No.: PCT/JP2011/056418

§ 371 (c)(1),
(2), (4) Date: Nov. 6, 2012

(87) PCT Pub. No.: WO2011/115220

PCT Pub. Date: Sep. 22, 2011

(65) Prior Publication Data

US 2013/0043126 A1 Feb. 21, 2013

(30) Foreign Application Priority Data

Mar. 19, 2010 (JP) ..... 2010-064554

(51) Int. Cl.
*C25B 9/00* (2006.01)
*C25B 1/00* (2006.01)
(Continued)

(52) U.S. Cl.
CPC ... *C25B 9/00* (2013.01); *C25B 1/26* (2013.01); *C25B 15/00* (2013.01); *C25B 15/08* (2013.01)

(58) Field of Classification Search
CPC ..... C25B 9/00; C25B 1/00; C25B 9/06; C25B 1/26
USPC ..... 204/242, 277, 193, 194
See application file for complete search history.

(56) References Cited

U.S. PATENT DOCUMENTS 2,163,793 A * 6/1939 Logan ..... 205/556
3,681,228 A * 8/1972 Komhyr ..... 204/431
(Continued)

FOREIGN PATENT DOCUMENTS

DE 692763 * 6/1953 ..... C25B 1/26
JP 08-127886 A 5/1996
(Continued)

OTHER PUBLICATIONS

International Search Report (Form PCT/ISA/210) issued on May 24, 2011, in the corresponding International Application No. PCT/JP2011/056418 and an English translation of the International Search Report. (5 pages).
(Continued)

*Primary Examiner* — Zulmariam Mendez
(74) *Attorney, Agent, or Firm* — Buchanan Ingersoll & Rooney PC

(57) ABSTRACT

An electrolyzer apparatus includes an anode tank having an anode and a cathode tank having a cathode which are provided separately from each other. The anode tank includes a feed opening for feeding electrolytic solution into the tank, an anode aeration device for feeding aeration air to the fed electrolytic solution, and a gas extraction pipe for guiding gas generated from the anode tank to outside the tank. A communication pipe allows the amount of electrolytic solution fed into the anode tank to flow into the cathode tank, and via the electrolytic solution in the communication pipe, electric conduction becomes possible between the anode and the cathode. An amount of gas generated by an electrolysis reaction inside the anode tank is discharged to the outside of the anode tank via the gas extraction pipe together with the aeration air. The electrolytic solution introduced into the cathode tank is discharged continuously.

4 Claims, 2 Drawing Sheets

(51) Int. Cl.

| | |
|---|---|
| ***C25B 9/06*** | (2006.01) |
| ***C25B 15/00*** | (2006.01) |
| ***C25B 15/08*** | (2006.01) |
| ***C25B 1/26*** | (2006.01) |

(56) References Cited

U.S. PATENT DOCUMENTS

| | | | |
|---|---|---|---|
| 5,593,554 | A | 1/1997 | Yamanaka et al. |
| 2011/0100833 | A1 | 5/2011 | Asada et al. |

FOREIGN PATENT DOCUMENTS

| | | | | |
|---|---|---|---|---|
| JP | 09-176879 | * | 7/1997 | ..... C25B 9/00 |
| JP | 09-279376 | A | 10/1997 | |
| JP | 2000-212787 | A | 8/2000 | |
| WO | 2009/154143 | A1 | 12/2009 | |

OTHER PUBLICATIONS

Written Opinion of the International Searching Authority (Form PCT/ISA/237) issued on May 24, 2011, in the corresponding International Application No. PCT/JP2011/056418. (3 pages).

Extended European Search Report issued on Feb. 14, 2014, in corresponding European Application No. 11756404.7.

F. Goodridge et al., "Experimental Methods and Equipment", in Norman L. Weinberg: "Technique of Electroorganic Synthesis", 1974, John Wiley & Sons, pp. 68-71.

* cited by examiner

ELECTROLYZER APPARATUS

TECHNICAL FIELD

The present invention relates to an electrolyzer apparatus of the type configured to generate a gas on the anode side thereof.

BACKGROUND ART

Conventionally, there is known a process for producing chlorine dioxide gas through an electrolysis reaction of an electrolytic solution containing chlorite (Patent Document 1).

It is well-known that there occurs change over time in the acid-base properties (pH) on the cathode side in the case of generating a gas on the anode side through an electrolysis reaction of an electrolytic solution. And, there is a concern that such change in the acid-base properties adversely affects the electrolytic solution present around the anode, leading to decrease in the stability of the electrolytic solution and progressive deterioration in the gas generation efficiency.

Patent Document 2 discloses a chlorine dioxide producing process in which a direct current is supplied to electrolytic solution inside a non-diaphragm electrolyzer tank having an anode and a cathode thereby to effect an electrolysis reaction for generating chlorine dioxide. More particularly, according to this process, the electrolysis reaction is carried out by supplying direct current to the electrolytic solution containing alkali chloride, alkaline chlorite, and a pH regulating agent, with the pH of the electrolytic solution being set from 4 to 8. In the course of the electrolysis reaction, in order to compensate for an amount of alkaline chlorite consumed in association with the electrolysis reaction, an amount of aqueous solution with alkaline chlorite is supplied to the electrolytic solution from the outside of the electrolyzer tank, and generated chlorine dioxide is extracted from the electrolytic solution. Thus, this process is configured as a single-liquid electrolysis type chlorine dioxide producing process.

PRIOR ART DOCUMENTS

Patent Documents

Patent Document 1: Japanese Unexamined Patent Application Publication No. 9-279376

Patent Document 2: International Publication WO 2009/154143

SUMMARY OF THE INVENTION

Object to be Solved by Invention

According to the chlorine dioxide producing process disclosed in Patent Document 2, by controlling the pH of the electrolytic solution, it is possible to prevent the acid-base properties of the cathode side from adversely affecting the anode side which would lead to decrease in the stability of the electrolytic solution. Hence, the problem of deterioration in the gas generation efficiency in the course of electrolysis reaction has been solved. It is believed that chlorine dioxide could be produced even more easily if the step of controlling pH could be omitted.

Therefore, the object of the present invention is to provide an electrolyzer apparatus capable of preventing acid-base properties of a cathode side from giving adverse effect on an anode side more easily.

Means for Solving Object

For accomplishing the above-noted object, according to a first characterizing feature of an electrolyzer apparatus relating to the present invention, in an electrolyzer apparatus in which an electrolysis reaction is effected with an anode and a cathode both being submerged in an electrolytic solution and a gas is generated from the anode side;

an anode tank having the anode and a cathode tank having the cathode are provided separately from each other;

the anode tank includes a feed opening for feeding an amount of electrolytic solution into the tank, an anode aeration device for feeding aeration air to the fed electrolytic solution, and a gas extraction pipe for guiding gas generated from the anode tank to the outside of the tank;

a communication pipe having one end thereof connected to the anode tank and the other end thereof connected to the cathode tank is provided for allowing the amount of electrolytic solution fed into the anode tank to flow into the cathode tank;

via the electrolytic solution in the communication pipe, electric conduction is established between the anode and the cathode; and an amount of gas generated by an electrolysis reaction inside the anode tank is discharged to the outside of the anode tank via the gas extraction pipe together with the aeration air and the electrolytic solution introduced into the cathode tank is discharged continuously.

With the above-described arrangement in operation, when an amount of electrolytic solution is fed through the feed opening into the anode tank having the anode, the electrolytic solution will be charged to this anode tank, in association of which the electrolytic solution will flow within the communication pipe interconnecting the anode tank and the cathode tank, so that the electrolytic solution will be charged to the inside of the cathode tank as well. In response to application of an electric potential to the opposite poles with the anode and the electrode being kept submerged in the electrolytic solution, an electric current will flow through the electrolytic solution inside the communication pipe, whereby an electrolysis will take place. In the anode tank, an anode aeration device is provided for feeding aeration air (air or inactive gas) into the electrolytic solution inside the anode tank, the gas generated by the electrolysis inside the anode tank will be discharged to the outside of the anode tank together with the air by the anode aeration device through the gas extraction pipe.

As the component (e.g. chlorite) in the electrolytic solution are consumed in the course of the electrolysis, it is necessary to supplement it from the outside of the electrolyzer tank. By feeding an amount of supplementary electrolytic solution either continuously or semi-continuously (intermittently) through the feed opening provided in the anode tank, there occurs a flow of electrolytic solution from the anode tank toward the cathode tank, which flow makes it difficult for the electrolytic solution present on the side of the cathode tank to flow in reverse toward the anode tank side. With this, it is possible to prevent change in the acid/base properties on the cathode side from adversely affecting the anode tank.

That is, through prevention of deterioration of the electrolytic solution in the anode tank, a low pH value can be maintained in the anode tank, so that the gas generation efficiency can be maintained high.

According to a second characterizing feature of an electrolyzer apparatus relating to the present invention, in an electrolyzer apparatus in which an electrolysis reaction is effected with an anode and a cathode both being submerged in an electrolytic solution containing chlorite and a chlorine dioxide gas is generated from the anode side;

an anode tank having the anode and a cathode tank having the cathode are provided separately from each other;

the anode tank includes a feed opening for feeding an amount of electrolytic solution into the tank, an anode aeration device for feeding aeration air to the fed electrolytic solution, and a gas extraction pipe for guiding gas generated from the anode tank to the outside of the tank;

a communication pipe having one end thereof connected to the anode tank and the other end thereof connected to the cathode tank is provided for allowing the amount of electrolytic solution fed into the anode tank to flow into the cathode tank;

via the electrolytic solution in the communication pipe, electric conduction is established between the anode and the cathode; and an amount of chlorine dioxide gas generated by an electrolysis reaction inside the anode tank is discharged to the outside of the anode tank via the gas extraction pipe together with the aeration air and the electrolytic solution introduced into the cathode tank is discharged continuously.

With the above-described arrangement in operation, since the electrolytic solution contains chlorite, a chlorine dioxide gas is generated from the anode side. And, the chlorine dioxide gas generated by the electrolysis inside the anode tank will be discharged to the outside of the anode tank through the gas extraction pipe together with the aeration air (air or inactive gas) by the anode aeration device. By feeding an amount of electrolytic solution containing chlorite either continuously or semi-continuously (intermittently) through the feed opening provided in the anode tank, there occurs a flow of electrolytic solution from the anode tank toward the cathode tank, which flows makes it difficult for the electrolytic solution present on the side of the cathode tank to flow in reverse toward the anode tank side. With this, it is possible to prevent change in the acid/base properties on the cathode side from adversely affecting the anode tank.

That is, through prevention of deterioration of the electrolytic solution in the anode tank, a low pH value can be maintained in the anode tank, so that the gas generation efficiency can be maintained high.

According to a third characterizing feature of an electrolyzer apparatus relating to the present invention, there are provided a gas collecting pipe having one end thereof connected to an upper portion of the anode tank and the other end thereof connected to an upper portion of the cathode tank and a cathode aeration device for feeding aeration air to the fed electrolytic solution present in the cathode tank; and an amount of chlorine dioxide dissolved and remaining in the electrolytic solution in the cathode tank is extracted together with the aeration air via the gas collection pipe and the gas extraction pipe to the outside of the anode tank.

With the above-described arrangement, via the gas collection pipe, the anode tank and the cathode tank are connected to each other at the respective upper portions thereof, and also there is provided a cathode aeration device for feeding aeration air (air or inactive gas) to the fed electrolytic solution present in the cathode tank. Therefore, even if an amount of chlorine dioxide gas generated in the anode tank and dissolved and remaining in the electrolytic solution therein should flow toward the cathode side through the communication pipe, this is extracted together with the aeration air by the cathode aeration device mounted inside the cathode tank, so that it can be extracted to the outside of the anode tank through the gas collection pipe and the gas extraction pipe.

According to a fourth characterizing feature of an electrolyzer apparatus relating to the present invention, there is provided a constricted portion which forms a smaller diameter at a portion inside the communication pipe.

With the above-described arrangement, the constricted portion can prevent reverse flow of the electrolytic solution inside the cathode tank into the anode tank even more effectively. Therefore, with the possibility of maintaining the pH inside the anode tank low, even greater improvement in the generation efficiency as well as the aeration efficiency can be expected. Moreover, since the constricted portion is formed only partially of the pipe, this hardly affects the electric current flow at the time of electricity conduction, so there is no risk of inviting cost increase for the communication pipe, either.

EMBODIMENT OF THE INVENTION

Next, an embodiment of the present invention will be described with reference to the accompanying drawings.

An electrolyzer apparatus according to the present invention is for use in an electrolysis for generating gas from the anode side which is carried out with the anode and the cathode being submerged in electrolytic solution.

Figure 1:
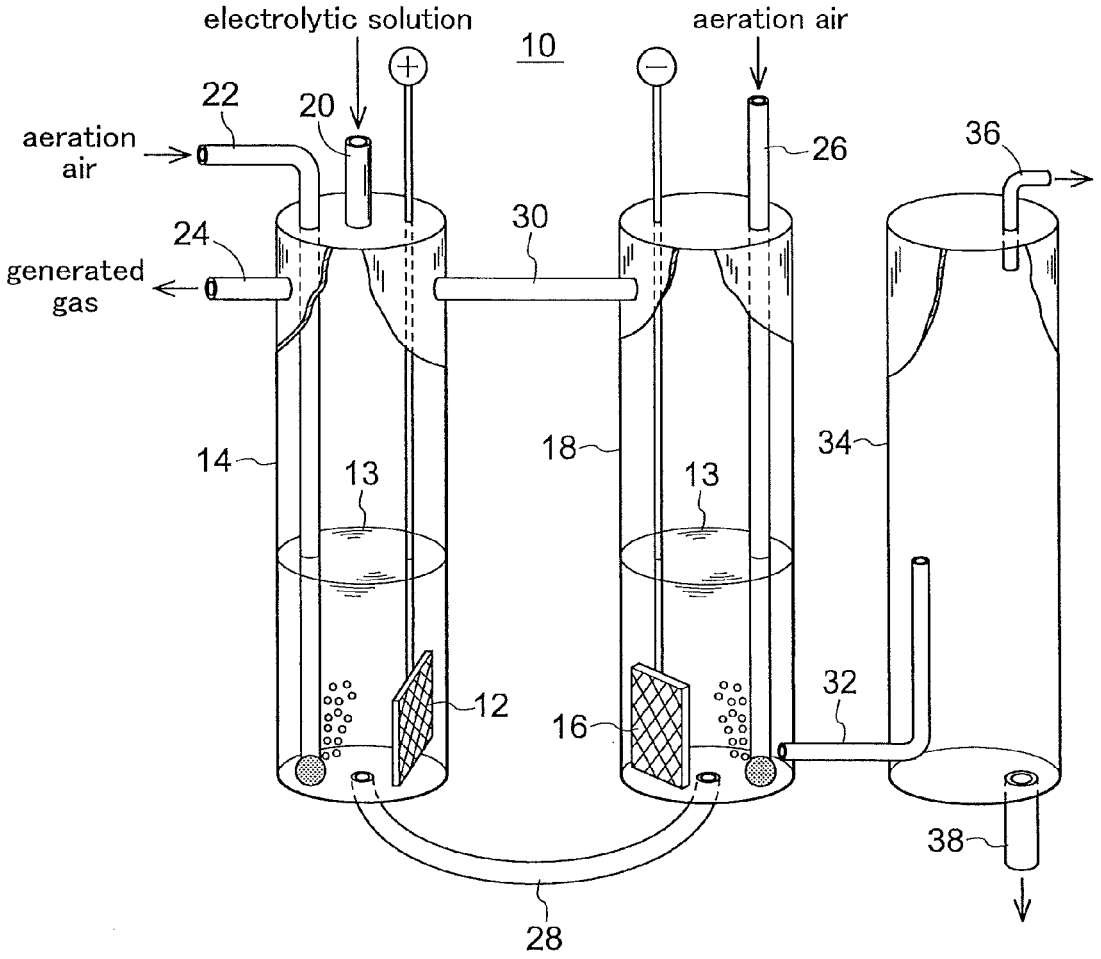
FIG. 1 is a schematic showing an electrolyzer apparatus according to the present invention.

As shown in FIG. 1, the electrolyzer apparatus 10 according to the present invention includes an anode tank 14 having an anode 12 and a cathode tank 18 having a cathode 16 provided separately from the anode tank 14. Each one of the anode tank 14 and the cathode tank 18 has an accommodating space for accommodating an amount of electrolytic solution therein. Within the range of the arrangement described above, the shapes and the volumes of the tanks are not particularly limited in the present invention.

In the instant embodiment, there is disclosed an arrangement in which the anode tank 14 and the cathode tank 18 are provided respectively as cylindrical tanks separate from each other. However, it will suffice as long as no easy mixing occurs between the electrolytic solution 13 inside the anode tank 14 and the electrolytic solution 13 in the cathode tank 18. Hence, it is also possible to form a cathode tank and an anode tank by partitioning a single accommodating space with a partition plate or the like.

The anode tank 14 includes a feed opening 20 for feeding an amount of electrolytic solution 13 into the tank, an anode aeration device 22 for feeding aeration air into the electrolytic solution 13 fed through the feed opening 20, and a gas extraction pipe 24 for guiding gas generated from this anode tank 14 to the outside of the tank.

The cathode tank 18 includes a cathode aeration device 26 for feeding aeration air into the electrolytic solution 13 present inside this cathode tank 18.

The anode aeration device 22 and the cathode aeration device 26 can be configured such that compressed air can be fed into the anode tank 14 and the cathode tank 18 by means of e.g. a compressor (not shown). In order to allow for guiding of gas generated through an electrolysis to the outside of the tank in an efficient manner, an arrangement will be provided such that the aeration air can be fed from the vicinity of the bottom portion of the anode tank 14 and the cathode tank 18, respectively.

Further, there is provided a communication pipe 28 having one end thereof connected to the anode tank 14 and the other end thereof connected to the cathode tank 18. This communication pipe 28 allows the electrolytic solution 13 fed to the anode tank 14 to flow therethrough into the cathode tank 18; and also through an amount of electrolytic solution 13 present inside this communication pipe 28, electricity conduction is made possible between the anode 12 and the cathode 16.

The communication pipe 28 can be formed of a narrow tubular member for instance. In this, the communication pipe 28 will be configured to have such an inner diameter as can effectively prevent reverse flow from of the electrolytic solution 13 from the cathode tank 18 to the anode tank 14 and as also does not impede the electricity conduction from the anode tank 14 to the cathode tank 18.

In order to prevent such reverse flow, in the communication pipe 28, for instance, the position for connection with the anode tank 14 can be set higher than the position for connection to the cathode tank 18. In this case, it will become more difficult for the gas generated in the anode tank 14 to move into the cathode tank 18.

And, an arrangement is provided such that the gas generated through the electrolysis inside the anode tank 14 may be discharged together with the aeration air through the gas extraction pipe 24 to the outside of the anode tank 14 and the electrolytic solution 13 introduced into the cathode tank 18 may be discharged into an exhaust solution tank 34 in a continuous manner.

For facilitating collection of the generated gas and aeration air, the gas extraction pipe 24, if desired, can be connected to a suction device (not shown).

Further, there is provided a gas collection pipe 30 having one end thereof connected to an upper portion of the anode tank 14 and the other end thereof connected to an upper portion of the cathode tank 18. Hence, any gas dissolved and remaining in the amount of electrolytic solution 13 present inside cathode tank 18 is extracted together with the aeration gas, through the gas collection pipe 30 and the gas extraction pipe 24 to the outside of the anode tank 14.

The gas extracted from the anode tank 14 together with the aeration air will be collected in a gas collection tank (not shown). In this, if needed, an arrangement can be provided for allowing separation of the desired gas from the aeration air.

(Generated Gas)

As the kinds of gas that can be produced by the electrolyzer apparatus 10 of the present invention, there can be cited chlorine dioxide, chlorine, ozone, etc. It is also possible to generate chlorine gas by using alkali chloride, alkali chloride earth in the electrolytic solution.

(Chlorite)

As some examples of chlorite for use in the present invention, there can be cited alkali metal chlorite, alkali earth metal chlorite. As some examples of alkali metal chlorite, there can be cited sodium chlorite, potassium chlorite, lithium chlorite, and as some examples of alkaline earth metal chlorite, there can be cited calcium chlorite, magnesium chlorite, and barium chlorite. Of these, in the respect of availability, sodium chlorite and potassium chlorite are preferred. And, sodium chlorite is most preferred. These alkali chlorites can be used singly or in a combination of two or more kinds.

The ratio of the chlorite in the electrolytic solution 13 ranges, preferably, from 0.1 wt to 30 wt %. If the ratio is below 0.1 wt %, there is possibility of occurrence of problem of shortage of chlorite in the generation of chlorine dioxide. If the ratio exceeds 30 wt %, there is possibility of the problem that there occurs saturation of chlorite and deposition of crystal thereof tends to occur. Considering safety and stability, generation efficiency, etc., the even more preferred range is from 0.1 wt % to 10 wt %. Incidentally, as chlorite is progressively consumed during electrolysis, it is necessary to supply it to the electrolytic solution from the outside of the tank. It is preferred that during electrolysis of the electrolytic solution 13, electrolytic solution containing chlorite should be supplied continuously or semi-continuously (intermittently) from the feed opening 20 of the anode tank 14.

(Electrodes)

As the electrodes for use in the electrolysis, conventional ones can be employed. Preferably, electrodes capable of minimizing generation of oxygen gas and providing efficient generation of chlorine dioxide are to be used. For instance, as the cathode material, titanium, stainless steel, nickel, nickel-chromium alloy, or other valve metals can be cited. Further, as the anode material, precious metal such as platinum, gold, palladium, iridium, rhodium, ruthenium, graphite, graphite felt, multilayered graphite cloth, graphite woven textile, carbon, or platinum coated material comprising titanium plated with platinum, oxides of valve metal such as titanium, tantalum, niobium, or zirconium and one coated with electrode catalyst can be suitably employed.

Incidentally, for efficient generation of chlorine dioxide, it is preferred to increase the electrode area and reduce the current density. Specifically, the electrode area should preferably be 1 $A/dm^2$ or lower.

(Aeration Air)

In the present invention, as the gas for aerating gas, such as generated chlorine dioxide, dissolved and remaining in the electrolytic solution for deaeration/collection, air is employed. However, the invention is not limited thereto. An inactive gas may be employed instead. As some non-limiting examples of inactive gas, nitrogen gas, argon, helium can be cited. Incidentally, the gas fed from the cathode aeration device 26 in the cathode tank 18 is chlorine dioxide gas, ozone gas. Chlorine gas cannot be aerated since it reacts with the alkali in the cathode tank 18 to become hypochlorite $ClO^-$.

(Electrolytic Solution)

In order to maximize the efficiency of electrolysis for production of maximum amount of chlorine dioxide, the electrolytic solution 13 used in the electrolyzer apparatus of the present invention can be mixed with alkali chloride, if necessary. As some non-limiting examples of alkali chloride, potassium chloride, sodium chloride, lithium chloride, calcium chloride can be cited. These can be employed either singly or in combination of two or more kinds. The ratio of alkali chloride in the electrolytic solution 13 is preferably 1 wt % or more. And, the ratio of 2 wt % or more and below the solubility is even more preferred. If the ratio of alkali chloride is below 1 wt %, stable generation of chlorine gas is not possible, so it may cause a trouble in the generation of chlorine dioxide. It is preferred to increase the concentration of alkali chloride in the electrolytic solution in order to be capable of generating chlorine dioxide in an efficient manner. Yet, if the concentration is near the solubility, there will tend to occur precipitation of alkali chloride in the electrolytic solution, which may provide adverse influence.

Embodiment

In this embodiment, there will be explained a case of generating chlorine dioxide as a generated gas.

FIG. 1 is a schematic explanation view of an electrolyzer apparatus 10 according to the present invention. As shown, there are provided separately a cylindrical anode tank 14 having a plate-like anode 12 formed of Pt/Ir plated titanium electrode (10 mm×20 mm) and a cylindrical cathode tank 18 having a plate-like cathode 16 formed of a titanium electrode (10 mm×20 mm).

The anode tank 14 includes a feed opening 20 for feeding an amount of electrolytic solution 13 into the tank, an anode aeration device 22 for feeding aeration air (air or inactive gas) into the electrolytic solution 13 fed from the feed opening 20, and a gas extraction pipe 24 for establishing air communication between the inside and the outside of the anode tank 14 and guiding gas generated in the anode tank 14 to the outside. Further, the cathode tank 18 too includes a cathode aeration device 26 for feeding aeration air (air or inactive gas) into the electrolytic solution 13.

The anode tank 14 and the cathode tank 18 are connected to each other at the respective lower portions thereof via a communication pipe 28. More particularly, there is provided the communication pipe 28 having an inner diameter ranging from 2 mm to 20 mm (diameter) having one end thereof connected to the lower portion of the anode tank 14 and the other end thereof connected to the lower portion of the cathode tank 18. Through this communication pipe 28, the electrolytic solution 13 fed to the anode tank 14 flows into the cathode tank 18 and also via the electrolytic solution 13 present inside this communication pipe 28, electric conduction is made possible between the anode 12 and the cathode 16.

Figure 3:
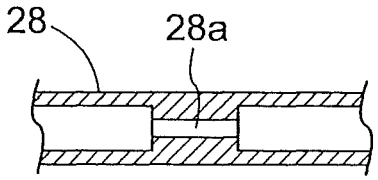
FIG. 3 is a schematic showing principal portions of a communication pipe having a constricted portion.

Incidentally, as shown in FIG. 3, in the communication pipe 28 interconnecting the two tanks, adjacent the cathode tank 18, there is provided a constricted portion 28*a* which forms a reduced inner diameter (diameter: 0.5 mm to 5 mm) for a part thereof (in the range of 2 mm to 20 mm length). Further, the anode tank 14 and the cathode tank 18 are connected to each other at the respective upper portions thereof via a gas collection pipe 30 for allowing air communication therebetween.

The inside of the anode tank 14 will be charged through the feed opening 20 with an amount of electrolytic solution 13 containing 25 wt % of sodium chlorite and sodium chloride (in 1000 g of electrolytic solution, 25 wt % of sodium chlorite 66 ml (sodium chlorite 2 wt %), 100% sodium chloride 100 g (sodium chloride 10 wt %), water 834 g).

In association with the above, the electrolytic solution 13 will flow through the communication pipe 28 to be charged in the cathode tank 18 as well. In response to application of a potential to the opposite poles with the anode 12 and the cathode 16 being kept submerged in the electrolytic solution 13, an electric current will flow through the electrolytic solution 13 inside the communication pipe 28, whereby an electrolysis reaction will take place (current: 5.4 mA, voltage 10V).

As the aeration air (air or inactive gas) is fed into the electrolytic solution 13 inside the anode tank 14 by the anode aeration device 22 provided in this anode tank 14, chlorine dioxide generated inside the anode tank 14 by the electrolysis will be discharged together with the aeration air through the gas extraction pipe 24 to the outside of the anode tank 14.

Figure 2:
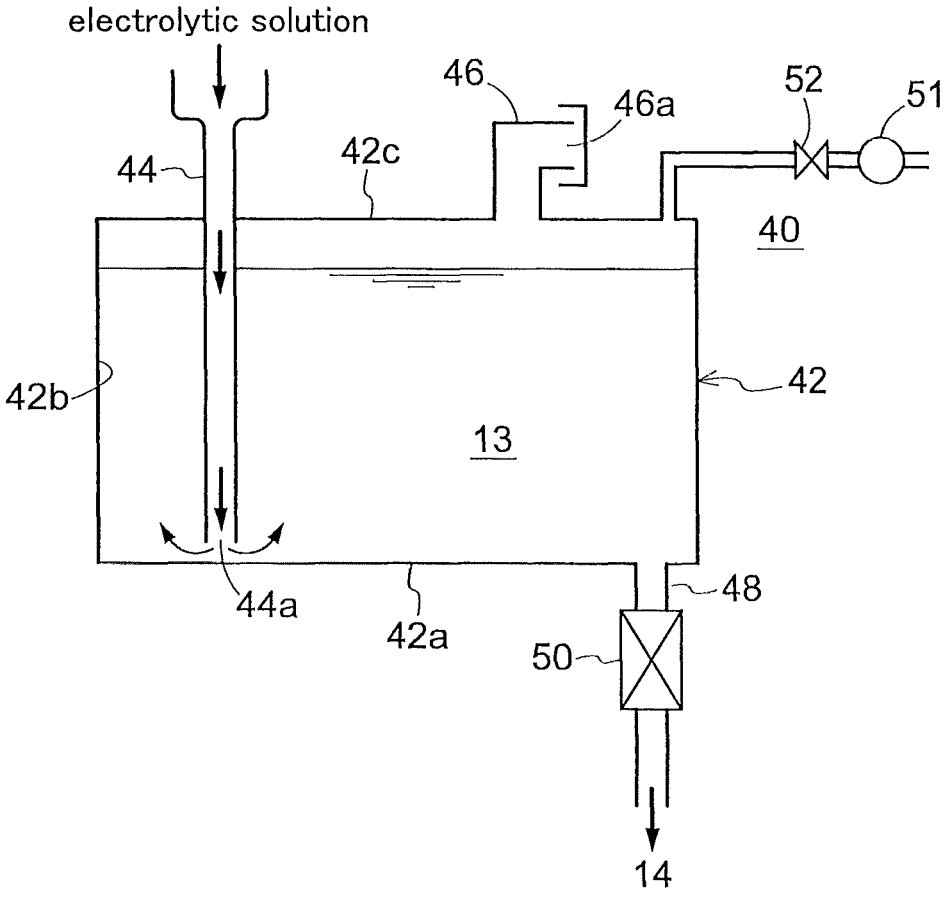
FIG. 2 is a schematic showing an electrolytic solution instillation device of use in the electrolyzer apparatus according to the present invention.

During the electrolysis, the electrolytic solution 13 may be supplemented intermittently and continuously into the anode tank 14 through the feed opening 20 with using an electrolytic solution instillation device 40 (FIG. 2). Specifically, the electrolytic solution 13 will be instilled continuously every five (5) minutes by a rate of 1 to 10 mL/h.

In this way, as the electrolytic solution 13 is continuously supplemented from the feed opening 20 of the anode tank 14 by the electrolytic solution instillation device, there occurs a slow flow of electrolytic solution 13 from the anode tank 14 toward the cathode tank 18, which flow effectively resists reverse flow of the electrolytic solution 13 of the cathode tank 18 to the anode tank 14. With this, it is possible to prevent deterioration of electrolytic solution when acid/base properties change on the cathode 16 side from adversely affects the anode side 14, so that the gas generation efficiency is maintained constant.

Since a slow flow of electrolytic solution 13 is occurring from the anode tank 14 toward the cathode tank 18, even if chlorine dioxide gas generated in the anode tank 14 and dissolved and remaining in the electrolytic solution 13 should move into the cathode tank 18 through the communication pipe 28 in accordance with this flow, this will be extracted together with the aeration air in the cathode tank 18 by the cathode aeration device 26, and it will be extracted continuously to the outside of the anode tank 14 via the gas collection pipe 30 and the gas extraction pipe 24.

The electrolytic solution 13 present inside the cathode tank 18 will flow down through the inside of the electrolytic solution collection pipe 32 into an exhaust solution tank 34 and then exhausted continuously from an exhaust pipe 38. And, the air pressure adjustment (pressure vent) in the course of this will be effected by a vent pipe 36.

As described above, in the communication pipe 28, there is provided the constricted portion 28*a* forming a reduced diameter at a portion thereof. With the formation of this constricted portion 28*a*, the reverse flow of the electrolytic solution 13 inside the cathode tank 18 into the anode tank 14 can be prevented even more effectively.

If the prevention of the reverse flow of the electrolytic solution 13 inside the cathode tank 18 into the anode tank 14 alone is considered, it will suffice to employ a pipe-like member which is narrow along the entire length thereof as the communication pipe 28. In such case, however, the flow of the electric current too becomes difficult. In contrast, by providing the constricted portion which forms a reduced diameter only at a portion of the communication pipe 28, it is possible not only to prevent the reverse flow of the electrolytic solution 13, but also to prevent the flow of electric current becoming difficult. In correspondence therewith, the electric potential for causing the electric current to generate chlorine dioxide can be lower, whereby safety against electric shock or the like can be ensured.

Incidentally, as the electrolytic solution instillation device 40 described above, e.g. a cubic-shaped agent solution tank 40 will be employed (see FIG. 2). More particularly, a tank main body 42 of the agent solution tank 40 consists of a bottom plate 42*a*, a peripheral side plate 42*b* and a top plate 42*c*. The top plate 42*c* mounts an inlet pipe 44 (having a vent 44*a* at its lower end portion) extending through the plate 42*c* downwards to reach the bottom plate 42*a* and a depressurization pipe 46 (having an opening 46*a* that can be freely opened/closed).

The bottom plate 42*a* mounts a feed/discharge pipe 48 connected to the feed opening 20 of the anode tank 14. This feed/discharge pipe 48 incorporates an electromagnetic valve 50 having a timer for adjusting the flow rate of the electrolytic solution 13 flowing therein.

In operation, the opening 46*a* of the depressurization pipe 46 will be opened and the feed/discharge pipe 48 will be closed. Then, under this condition, the electrolytic solution 13 after its adjustment will be introduced into the tank main body 42 through the inlet pipe 44 until the electrolytic solution 13 is charged up to a predetermined level (see the virtual dot line in FIG. 2). Thereafter, the opening 46*a* of the depressurization pipe 46 will be closed and the feed/discharge pipe 48 will be opened, whereby the electrolytic solution 13 inside the tank main body 42 will flow down under the effect of gravity and will be fed into the anode tank 14 via the feed opening 20. In the course of this, since the opening 46*a* of the depressurization pipe 46 is closed, the inside pressure of the tank main body 42 will become a negative pressure in association with the downflow of the electrolytic solution 13.

As the level of the electrolytic solution 13 inside the tank main body 42 is progressively lowered and when this level is stopped at the lower end of the inlet pipe 44, the inlet flow rate will become stable. Hence, ON-OFF operations of the electromagnetic valve 50 having a timer will be started (to open the feed/discharge pipe 48 intermittently by a predetermined period), thus adjusting the feed amount of the electrolytic solution 13 from the agent solution tank 40 to the anode tank 14.

While the electrolytic solution 13 is being fed to the anode tank 14, the electrolytic solution 13 inside the agent solution tank 40 will decrease correspondingly. However, since the inside pressure of the tank main body 42 has become a negative pressure as described above and also the vent hole 44*a* is provided at the lower end of the inlet pipe 44 communicated with the atmosphere, the level of the electrolytic solution 13 stopped at the lower end position of the inlet pipe 44 will be maintained as it is.

Therefore, the electrolytic solution 13 tending to flow inside the feed/discharge pipe 48 is free from the pressure change that occurs due to the change in the electrolytic solution storage amount (self weight change) inside the tank main body 42. As a result, the flow rate of the electrolytic solution 13 flowing inside the feed/discharge pipe 48 can be extremely stable, so that even if this rate is very low, it can be maintained at a substantially fixed rate. With this, even if such low rate gas generation of the gas generation amount per unit period being a relatively small (e.g. 0.01 mg to 100 mg/h) is contemplated, this can be coped with sufficiently and the gas can be generated continuously by a substantially fixed ratio for an extended period of time.

Incidentally, in the case of e.g. sudden rise of the temperature at the site of installation (1 to 10° C./min.), when the room temperature varies, the air inside the agent solution tank 40 of the electrolytic solution instillation device will be warmed and expanded, thereby to push the electrolytic solution 13 into the inlet pipe 44, thus increasing the liquid level and increasing the flow rate accordingly. In such case, if an air displacement pump 51 and a flow rate adjustment valve 52 are provided as shown in FIG. 2, the liquid level will become even more stable.

INDUSTRIAL APPLICABILITY

The electrolyzer apparatus according to the present invention can be used for an electrolysis for generating a gas from the side of the anode which is effected with the anode and the cathode being kept submerged in an electrolytic solution.

DESCRIPTION OF REFERENCE NUMERALS AND MARKS

10 electrolyzer apparatus
12 anode
13 electrolytic solution
14 anode tank
16 cathode
18 cathode tank
20 feed opening
22 anode aeration device
24 gas extraction pipe
26 cathode aeration device
28 communication pipe
28*a* constricted portion
30 gas collection pipe

The invention claimed is:

1. An electrolyzer apparatus in which an electrolysis reaction is effected with an anode and a cathode both being submerged in an electrolytic solution containing chlorite and a chlorine dioxide gas is generated from the anode side;

wherein an anode tank having the anode and a cathode tank having the cathode are provided separately from each other;

the anode tank includes a feed opening for feeding an amount of electrolytic solution into the tank, an anode aeration device for feeding aeration air to the fed electrolytic solution, and a gas extraction pipe for guiding gas generated from the anode tank to outside of the tank;

a communication pipe having one end thereof connected to a lower portion of the anode tank and the other end thereof connected to a lower portion of the cathode tank is provided for generating a flow of electrolytic solution from the anode tank to the cathode tank;

via the electrolytic solution in the communication pipe, electric conduction is established between the anode and the cathode;

an amount of chlorine dioxide gas generated by an electrolysis reaction inside the anode tank is discharged to the outside of the anode tank via the gas extraction pipe together with the aeration air and the electrolytic solution introduced into the cathode tank is discharged continuously;

a gas collection pipe having one end thereof connected to an upper portion of the anode tank and the other end thereof connected to an upper portion of the cathode tank;

a cathode aeration device for feeding aeration air to the fed electrolytic solution present in the cathode tank; and an amount of chlorine dioxide dissolved and remaining in the electrolytic solution in the cathode tank, together with the aeration air, is allowed to flow into the anode tank via the gas collection pipe to merge the fed amount of chlorine dioxide into an amount of chlorine dioxide gas generated in the anode tank, and is extracted via the gas extraction pipe to the outside of the anode tank.

2. The electrolyzer apparatus according to claim 1, wherein there is provided a constricted portion which forms a smaller diameter at a portion inside the communication pipe.

3. The electrolyzer apparatus according to claim 1, wherein in the communication pipe, a position for connection to the anode tank is set higher than a position for connection to the cathode tank.

4. The electrolyzer apparatus according to claim 2, wherein in the communication pipe, a position for connection to the anode tank is set higher than a position for connection to the cathode tank.

* * * * *